US006711273B2

(12) United States Patent
Bebenroth

(10) Patent No.: US 6,711,273 B2
(45) Date of Patent: Mar. 23, 2004

(54) CHIN LOOP HEADSET

(75) Inventor: Wolf-Dietrich Bebenroth, Celle (DE)

(73) Assignee: Sennheiser electric GmbH & Co. KG, Celle (DE)

( * ) Notice: Subject to any disclaimer, the term of this patent is extended or adjusted under 35 U.S.C. 154(b) by 0 days.

(21) Appl. No.: 09/939,402

(22) Filed: Aug. 24, 2001

(65) Prior Publication Data

US 2002/0025057 A1 Feb. 28, 2002

(51) Int. Cl.[7] ..... H04R 25/00
(52) U.S. Cl. ..... 381/379; 381/378
(58) Field of Search ..... 381/379, 374, 381/382, 309, 328, 330

(56) References Cited

U.S. PATENT DOCUMENTS 3,671,685 A * 6/1972 McCabe
4,277,654 A * 7/1981 Penning

FOREIGN PATENT DOCUMENTS

| | | |
|---|---|---|
| DE | 32 26 577 A1 | 2/1983 |
| DE | 31 18 294 C2 | 12/1985 |
| DE | 35 11 114 A1 | 10/1986 |
| GB | 2 019 160 A | 10/1979 |

OTHER PUBLICATIONS

English Abstract of DE 35 11 114 A1.
English Abstract of DE 31 18 294 C2.
English Abstract of DE 32 26 577A1.

* cited by examiner

*Primary Examiner*—Sinh Tran
(74) *Attorney, Agent, or Firm*—Reed Smith LLP

(57) ABSTRACT

A chin loop headset comprising two acoustic transducers, and two side pieces, to the upper ends of which are fixed respective ones of the transducers and the upper ends of which can be moved elastically away from each other and which are connected together at their lower ends. The distance between the upper ends is adjustable at the connection of the lower ends.

8 Claims, 1 Drawing Sheet

CHIN LOOP HEADSET

BACKGROUND OF THE INVENTION a) Field of the Invention

The present invention concerns a chin loop headset comprising two acoustic transducers and two side pieces, to the upper ends of which is secured a respective one of the transducers and the upper ends of which can be moved elastically away from each other and which are connected together at their lower ends.

b) Description of the Related Art

As is known, headsets are in the form of a chin loop headset, in particular when circuit boards with electrical circuits are to be mounted to the headset. Known chin loop headsets for that purpose have a small housing which can be positioned under the chin in front of the chest of the user and from which two elastic side pieces lead in a slightly arcuate configuration, past the cheeks, to the ears. Acoustic transducers are mounted there at the upper ends of the side pieces. The transducers are usually fitted with ear pads which cushion the pressure with which the transducers are pressed against the ears gently and in a manner which is comfortable from the point of view of the user. The contract pressure of the transducers against the ears is produced by the upper ends of the side pieces with the transducers being moved away from each other and, when that happens by the side pieces being elastically transversely deformed over their length so that the ear pads of the acoustic transducers, which are then placed in the external parts of the ears of the user, are resiliently lightly pressed into the ears and are held therein and ensure good acoustic transmission.

Unlike the situation with headsets with side pieces which extend over the head, the entire weight of chin loop headsets is supported in the pressure-sensitive external parts of the ears of the user. However, so that the chin loop headset does not merely slip out of the ears of the user due to its own weight but at the least in the event of slight movements of the head, the spring characteristics of the elastically laterally deformable side pieces and the initial non-deflected condition of the side pieces prior to the chin loop headset being donned by the user are matched to each other in such a way that, upon deflection of the side pieces by virtue of the transducer ear pads being fitted into the ears, there is sufficiently great contact pressure prevailing thereagainst.

A problem here, however, is that different users have individually different distances between their ears and that as a result a contact pressure which is individually different occurs, depending on that individual distance between ears. Consequently, in the case of users who have narrow heads, a chin loop headset may have a tendency to slip out of the ears while the same chin loop headset when used by a person with a wide head causes unpleasant pressure in the ears.

OBJECT AND SUMMARY OF THE INVENTION

The primary object of the invention is, therefore, that of providing a chin loop headset which, irrespective of individual dimensions of the anatomy of the head of its user, ensures a contact pressure for the acoustic transducers against the external parts of the ears, which is sufficiently strong to provide a secure hold and sufficiently weak that it is not perceived as being unpleasant by the user.

In accordance with the invention, that object is attained by a chin loop headset comprising two acoustic transducers and two side pieces, each having an upper end. To the upper ends of the side pieces are fixed respective ones of the transducers. The upper ends of the side pieces are to be moved elastically away from each other. The side pieces are connected together at lower ends thereof at a connection. Means are included for adjusting the distance between the upper ends at the connection of the lower ends.

In accordance with the invention, a chin loop headset has two acoustic transducers, one for each ear, and two side pieces, to the upper ends of which are fixed a respective one of the transducers for positioning at the ear. At their lower end the side pieces are connected together and thus together form a bay-like or arch-like configuration which, when a user fits the chin loop headset, extends from one ear to the other under the chin of the user. The upper ends of the side pieces can be moved elastically away from each other to produce contact pressure for the transducers against the ears, preferably by way of pads between the transducers and the ears, being distributed more comfortably for the user over a larger area of the external parts of the ears, the side pieces being elastically movable away from each other, more specifically preferably by the side pieces being elastically transversely deformable over their length. In accordance with the invention, in such a chin loop headset, the distance between the upper ends of the side pieces, that is to say the distance between the ear contact surfaces of the transducers, can be adjusted at the connection of the lower ends of the side pieces, namely in particular before the chin loop headset is fitted by the user. In that way the spring travel of the side pieces which, as described in relation to the state of the art, produces the contact pressure with which the transducers are pressed against the ears, can be adjusted to the individual width of the head of the user (the distance between the external parts of the ears of the user and in that respect in particular the surface regions which are in contact with the transducers when the headset is fitted). If that adjustment operation is effected when the chin loop headset according to the invention is fitted in position, the distance between the transducers at the upper ends of the side pieces admittedly does not change, for when the chin loop headset is fitted that distance is naturally predetermined by the distance between the ears, but—and this also corresponds to the basic object of the invention—the biasing force of the upper ends of the side pieces, which can be moved elastically away from each other, against the external parts of the ears of the user is changed by the change in resilient deflection of the side pieces, and thus in accordance with the invention it is possible to adjust the contact pressure of the transducers (or the pads preferably mounted on the transducers) against the pressure-sensitive external parts of the ears of the user.

Preferably a hinge joint forms the connection between the lower ends of the side pieces, which can be arrested at any angle of opening. This therefore affords an adjustable width in respect of the bay-like configuration formed by the side pieces and consequently in accordance with the invention this also involves an adjustable distance between the upper ends of the side pieces, where the transducers are fixed.

By way of example, at the hinge joint the side pieces are movable from a rest position with a small angle between the side pieces and a small distance between their upper ends into an operative position with a larger angle between the side pieces and a larger distance between their upper ends, and a spring in the region of the connection biases the side pieces towards each other in the direction of the rest position. As a result, the chin loop headset in accordance with the invention moves, with spring actuation, into the space-saving rest position when the side pieces are not actuated and moved away from each other by a user. Preferably, the movement of the side pieces in the direction of the operative position is limited by an abutment which is adjustable for adjustment in accordance with the invention of the distance between the upper ends of the side pieces. More specifically, by virtue of the fact that the angular position of the abutment is so adjustable that the side pieces which are moved against the abutment in the operative position assume relative to each other an angle which is adjustable by means of the abutment, in accordance with the invention the distance between the transducers at the upper end's of the side pieces can also be adjusted by way of the displacement of the abutment.

In this preferred embodiment of the chin loop headset according to the invention, therefore, the user moves the side pieces out of the rest position against the biasing force of the spring—which preferably has a comparatively small spring constant—into the operative position, in a condition of bearing against the adjustable abutment. He now bends the upper ends away from each other so that the side pieces are transversely deformed over their length elastically—with preferably a greater spring constant than the spring—and the acoustic transducers at the upper ends of the side pieces are then fitted into the ears of the user. If the user now finds that the biasing force of the side pieces against his ears is excessively low, he displaces the abutment in the direction of a smaller angle between the side pieces in order to increase the magnitude of the resilient deflection of the side pieces—that is to say the contact pressure—against his ears on his head between the side pieces.

Or, if the transducers press unpleasantly strongly into his ears, he suitably displaces the abutment in the direction of a larger angle between the side pieces, to relieve the spring force exerted thereby.

Preferably the spring pulls the side pieces into the rest position so that in that way a button for example for switching off the headset, is actuated in the rest position.

The invention is described hereinafter with reference to the accompanying drawing.

BRIEF DESCRIPTION OF THE DRAWING

The drawing is a front view of a chin loop headset according to the invention, in regard to the circuit housing of which the cover (not shown) which has been removed allows a free view into the housing.

DESCRIPTION OF THE PREFERRED EMBODIMENTS

Figure 1:
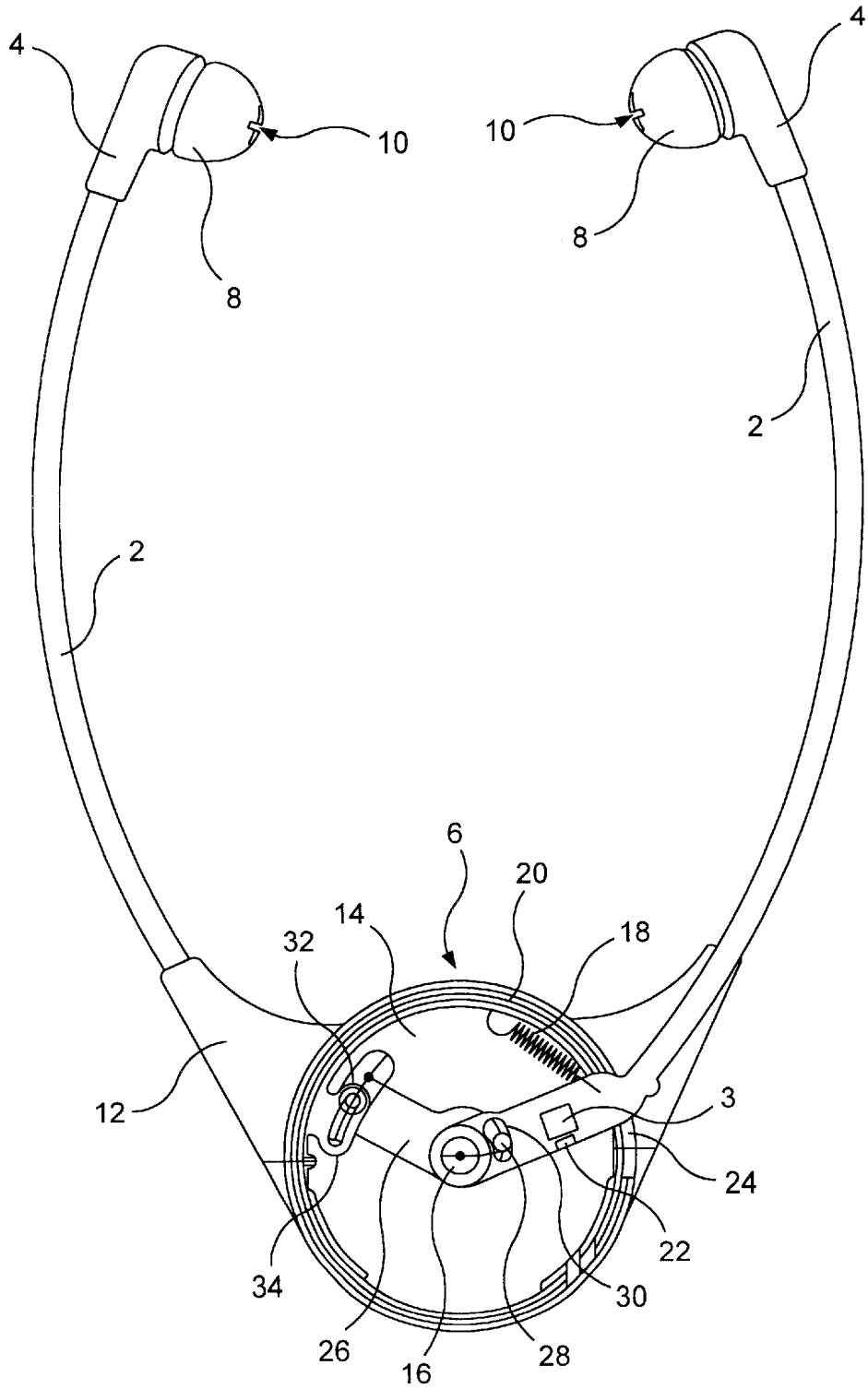

Referring to the drawing, shown therein is a chin loop headset comprising two side pieces 2 and two acoustic transducers 4 at the upper ends of the side pieces 2. At their lower ends the side pieces 2 are connected together at a housing 6 and thus form an upwardly open bay-like or arch-like configuration. In this case the side pieces 2 are curved arcuately outwardly and the acoustic transducers 4 at the upper ends of the side pieces 2 are directed inwardly with ear pads 8 which also face inwardly into the bay-like configuration formed in that way. At their inward tips the ear pads 8 (of rubber or elastic plastic material) each have a respective passage 10 comprising two crossed slots in order to guarantee a good acoustic connection from the transducers 4 through the ear pads 8 in the direction of the ears (not shown).

The upper ends of the side pieces 2 with the acoustic transducers 4 and the ear pads 8 can be moved elastically away from each other, by the side pieces 2 being transversely outwardly elastically deformable over their arcuate length. In that way, the bay-like configuration formed by the side pieces 2 can be elastically enlarged and the ear pads 8 on the acoustic transducers 4 can be fitted by the user into his ears, in which case the side pieces 2 go along the cheeks of the user downwardly to the chin where, under the chin, the housing 6 as the connection between the lower ends of the side pieces 2 rests on the chest (not shown) of the user.

The left-hand one of the side pieces 2 fits into a shaft 12 which is formed in one piece with a cover 14 which forms the rear wall of the housing 6 which is in the form of a circular cylinder. The fight-hand one of the side pieces 2 is pivotably connected by way of a hinge joint to an access member or spindle 16 which is coaxial with the housing 6, and is thus connected to the left-hand one of the side pieces 2 by the housing 6. In the interior of the housing 6, a tension coil spring 18 is biased with respect to the axis 16 in the peripheral direction about the axis 16 in the counter-clockwise direction, between the right-hand one of the side pieces 2 and the wall of the housing 6 which forms the periphery of the housing 6. In this case the spring 18 pulls the right-hand one of the side pieces 2, with a projection 22 provided on the fight-hand one of the side pieces 2 in the counter-clockwise direction against a button 3 for switching off the headset. The button is arranged on a circuit board (not shown) which is disposed in a plane perpendicular to the axis 16, above the elements described herein in the housing 6.

The right-hand one of the side pieces 2 is therefore pivotably mounted in the housing 6 on the axis member 16 which is coaxial therewith and can thus pivotably assume angles which are different from the left-hand one of the side pieces 2. For that purpose, the right-hand one of the side pieces 2 can pass pivotably over an angle of approximately 15° with respect to the housing 6, insofar as the right-hand one of the side pieces 2 is extended outwardly out of the housing 6 through a slot 24 of suitable width in the peripheral wall of the housing 6. The wall of the slot 24 serves in that case as an abutment and limiting means for defining the range of movement of the right-hand one of the side pieces 2 with respect to the left-hand one thereof, in the peripheral direction of the housing 6. The spring 18 pulls the right-hand one of the side pieces 2 into the extreme position of that range of movement in the counter-clockwise direction, into the rest position in which the projection 22 actuates the button (not shown).

The extreme position of the right-hand one of the side pieces 2 in the clockwise direction in the peripheral direction of the housing 6—the position therefore into which a user pulls the side pieces 2 away from each other in order to fit the headset in position—is adjustable by an adjusting lever 26 which is also mounted on the axis member 16. For that purpose it has a projection 28 which engages into a slot 30 which extends in the peripheral direction around the axis member 16, the slot being formed on the side piece 2 within the housing 6. The lever 26 with which the projection 28 is pivotable about the axis 16 in the slot 30 is limited in respect of its range of pivotal movement by a screw 32 which is fitted on the one hand through a bore in the lever 26 and on the other hand through a second slot 34 which also extends on the housing 6 in the peripheral direction. The head of the screw 32 extends out of the housing 6 and can therefore be actuated from the exterior in order, when the screw 32 is tightened, to fix the lever 26—being adjustable about the axis 16. By virtue of that design configuration, the projection 28 as part of the lever 26 is adjustably pivotable in the slot 30 in the right-hand one of the side pieces 2—and serves there as an abutment for the right-hand one of the side pieces 2 about the axis 16, for limiting the mobility of the right-hand one of the side pieces 2 in the clockwise direction. More specifically, the edge of the slot 30 as part of the right-hand one of the side pieces 2 bears against the projection 28 as part of the lever 26. And, because the lever 26 is fixed by means of the screw 32 in the housing 6 which in turn is fixedly connected to the left-hand one of the side pieces 2, the above-described design configuration adjustably limits the mobility of the right-hand one of the side pieces 2 with respect to the left-hand one of the side pieces 2, in such a way that the ends of the side pieces 2 can be moved away from each other only as far as a distance which is adjustable as described, before the side pieces 2 are elastically—that is to say resiliently—transversely deformed and, by virtue of that deformation, produce the contact pressure of the ear pads 8 against the external parts (not shown) of the ears of the user. Consequently that contact pressure is adjustable by the described adjustability in terms of mobility of the side pieces 2 relative to each other, insofar as, by fixing the position of the side pieces 2 relative to each other, prior to the resilient deflection thereof, it is possible to individually adjust the spring travel of the side pieces, by which the side pieces 2 are deflected by the individual distance between the ears of a user of the headset.

While the foregoing description and drawings represent the present invention, it will be obvious to those skilled in the art that various changes may be made therein without departing from the true spirit and scope of the present invention.

What is claimed is:

1. A chin loop headset comprising:

two acoustic transducers;

two side pieces, each having an upper end;

to the upper ends of said side pieces are fixed respective ones of the transducers;

said upper ends of said side pieces able to be moved elastically away from each other;

said side pieces being connected together at lower ends thereof at a connection;

means for adjusting the distance between the upper ends at the connection of the lower ends, wherein an abutment limits the movement of the headset into an operative position, said adjusting means being capable of continuous and toothless adjustment of the lower ends so as to adjust the distance between said upper ends to accommodate a wearer, said adjusting means including an adjusting lever coaxially mounted with the lower end of one side piece and operable to rotate the lower end of the one side piece; and a button for switching off the headset operable to be actuated in a rest position.

2. The headset according to claim 1, wherein the side pieces are movable out of the rest position with a small distance between the upper ends into the operative position with a larger distance between the upper ends and that the connection has a spring which biases the side pieces into the rest position.

3. The headset according to claim 2, wherein the abutment is adjustable for adjusting the distance between the upper ends.

4. The headset according to claim 1, wherein the connection has a hinge joint.

5. A chin loop headset comprising:

a pair of acoustic transducers;

a pair of side pieces, each having an upper end and a lower end, the transducers being fixed to the upper ends of the respective side pieces, the upper ends of said side pieces being elastically movable with respect to each other;

a housing attached to the lower ends of the side pieces; and an adjustment mechanism coupled to the lower ends of the side pieces and capable of continuous and toothless adjustment of the lower ends so as to adjust the distance between the upper ends to accommodate a wearer, the adjustment mechanism including an adjusting lever coaxially mounted with the lower end of one side piece and operable to rotate the lower end of the one side piece.

6. The chin loop headset according to claim 5, further comprising an abutment disposed within the housing which limits the movement of at least one lower end with respect to the housing.

7. The chin loop headset according to claim 5, wherein the adjustment mechanism further includes a screw threadably attached to the adjusting lever and operable to fix the adjusting lever with respect to the housing.

8. A chin loop headset comprising:

a pair of acoustic transducers;

a pair of side pieces, each having an upper end and a lower end, the transducers being fixed to the upper ends of the respective side pieces, the upper ends of said side pieces being elastically movable with respect to each other;

a housing attached to the lower ends of the side pieces;

an adjustment mechanism coupled to the lower ends of the side pieces and capable of continuous and toothless adjustment of the lower ends so as to adjust the distance between the upper ends to accommodate a wearer, the adjustment mechanism including an adjusting lever coaxially mounted with the lower end of one side piece and operable to rotate the lower end of the one side piece; and a button housed within the housing and operable to switch off the headset when the headset is in a rest position.

* * * * *

UNITED STATES PATENT AND TRADEMARK OFFICE

CERTIFICATE OF CORRECTION

PATENT NO. : 6,711,273 B2
DATED : March 23, 2004
INVENTOR(S) : Wolf-Dietrich Bebenroth It is certified that error appears in the above-identified patent and that said Letters Patent is hereby corrected as shown below:

Title page,
Item [30], Foreign Application Priority Data, should read as follows:
-- Aug. 31, 2000 [DE] Germany …….. 100 42 691.3 --

Signed and Sealed this

Seventh Day of September, 2004

JON W. DUDAS
*Director of the United States Patent and Trademark Office*